United States Patent [19]

Yoshikawa et al.

[11] 4,456,304

[45] Jun. 26, 1984

[54] SHIELD TUNNELING MACHINE AND EARTH REMOVING APPARATUS THEREFOR

[75] Inventors: Tadao Yoshikawa, Ibaraki; Shoji Nishida, Higashi-osaka, both of Japan

[73] Assignee: Hitachi Shipbuilding & Engineering Co., Ltd., Osaka, Japan

[21] Appl. No.: 382,708

[22] Filed: May 27, 1982

[30] Foreign Application Priority Data

Jun. 15, 1981 [JP] Japan ..... 56-88157[U]

[51] Int. Cl.[3] ..... E21D 9/08

[52] U.S. Cl. ..... 299/33; 405/144

[58] Field of Search ..... 299/18, 56, 33, 57, 299/87; 405/144; 175/173, 323

[56] References Cited

U.S. PATENT DOCUMENTS 1,604,896 10/1926 Foltz ..... 175/323 X 4,167,289 9/1979 Ono et al. ..... 299/33 X

*Primary Examiner*—Ernest R. Purser

*Attorney, Agent, or Firm*—Barnes, Kisselle, Raisch, Choate, Whittemore & Hulbert

[57] ABSTRACT

An earth removing apparatus for a shield tunneling machine comprising a tubular casing having an excavated earth inlet at one end and a closable outlet for excavated earth at the other end, and a double-shaft screw conveyor rotatably supported by the casing at two portions. The screw conveyor is supported on the casing in the vicinity of its earth inlet by an annular member fitted in an annular recess in the casing, with a bearing provided between the annular member and the casing. Since the forward end of the screw conveyor need not be supported at the center of rotation of the cutter head of the tunneling machine, the apparatus can be designed with greater freedom and is free of objections in its mechanical structure.

8 Claims, 8 Drawing Figures

SHIELD TUNNELING MACHINE AND EARTH REMOVING APPARATUS THEREFOR

The present invention relates to a shield tunneling machine for excavating tunnels in earth foundations, and more particularly to an earth removing apparatus for use in the shield tunneling machine.

An earth removing apparatus is already known for use in shield tunneling machines which comprises a tubular casing disposed horizontally for holding a pressure chamber formed in the shield main body in communication with an atmospheric pressure compartment in the body, an outer rotary shaft rotatably disposed within the casing and provided with an earth conveying screw blade on its outer periphery, and an inner rotary shaft rotatably provided within the outer rotary shaft and having a projection extending through one end of the outer rotary shaft into the pressure chamber, the shaft projection being provided with an earth kneading screw blade. The inner and outer rotary shafts and the screw blades constitute a screw conveyor. The outer rotary shaft is rotatably supported at one portion by the casing, while the forward end of the inner rotary shaft is rotatably supported at the center of rotation of a cutter head positioned in front of the pressure chamber, whereby the screw conveyor is retained in a specified position as supported at two points.

With this earth removing apparatus, the earth excavated by the cutter head and ingressing into the pressure chamber can be efficiently kneaded by the kneading screw blade with slime injected into the pressure chamber, consequently building up the internal pressure of the chamber and effectively preventing the forward ground from collapsing. However, the above arrangement is limited in the freedom of design since the screw conveyor must be arranged horizontally with its forward end supported at the center of rotation of the cutter head. Furthermore the arrangement wherein the conveyor end is supported by the cutter head which is rotatingly driven entirely independently of the conveyor involves problems mechanically. When the shield main body has a small diameter, there arises a need to incline the earth removing apparatus so that an earth discharge conveyor can be disposed in the rear of the apparatus. This gives rise to the problem that the cutter head must also be inclined so as to be perpendicular to the double rotary shaft of the screw conveyor. The slime mentioned is used to give lubricity to the earth, reduce its sheating force and clog up the interstices between the earth particles.

In view of the above problems, an object of the present invention is to provide an earth removing apparatus for shield tunneling machines which can be designed with increased freedom, is free of problems in mechanical construction and is capable of effectively preventing collapse of the ground by efficiently kneading the excavated earth.

To fulfill this object, the present invention provides an earth removing apparatus for a shield tunneling machine comprising a tubular casing having an excavated earth inlet at one end and a closable outlet for excavated earth at the other end; a hollow outer rotary shaft rotatably disposed within the casing and provided with earth conveying blade means on its outer periphery, the rotary shaft being rotatably supported on the casing in the vicinity of the above-mentioned one end thereof by an annular member provided around the blade means; and an inner rotary shaft rotatably extending through the outer rotary shaft and having a projection extending through one end of the outer rotary shaft and through the earth inlet of the casing, the shaft projection being provided with earth kneading blade means.

With the above apparatus, the inner and outer rotary shafts, the earth conveying blade means and the earth kneading blade means provide a screw conveyor, which is supported at one point by the annular member on the casing and, at another point in a suitable position (which, however, is irrelevant to the subject of the invention), also by the casing. Thus the conveyor is made completely independent of the other rotary members (for example, the cutter head) of the tunneling machine, so that the earth removing apparatus can be designed with increased freedom without any likelihood of mechanical objections for incorporation into a shield tunneling machine.

According to a preferred embodiment of the invention, the annular member is positioned in an annular recess formed in the casing and is rotatably supported by a bearing fitted in the recess.

Whereas the annular member would impede transport of earth if projecting from the inner surface of the casing, such objection is avoidable when the annular member is installed as fitted in the annular recess.

Another object of the invention is to provide a shield tunneling machine equipped with the earth removing apparatus of above construction.

Various features and advantages of the invention will become apparent from the embodiments to be described below with reference to the accompanying drawings, in which.

Before describing embodiments of the invention, the construction and problems of a conventional earth removing apparatus will be described in detail with reference to FIG. 1.

Figure 1:
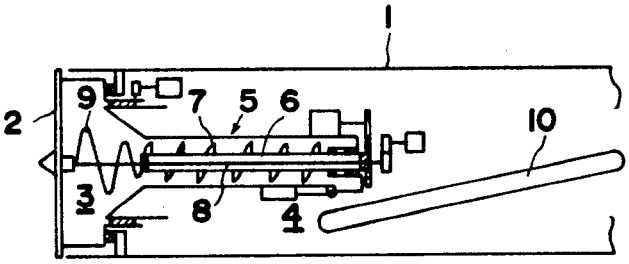
PRIOR ART FIG.1
FIG. 1 is a view in longitudinal section showing a shield tunneling machine equipped with a conventional earth removing apparatus.

Referring to FIG. 1, a cutter head 2 is rotatably mounted on one end of a shield main body 1, which has in its interior a pressure chamber 3 immediately behind the cutter head 2 and an atmospheric compartment 4 in the rear of the chamber 3. An earth removing apparatus 5 is positioned horizontally to hold the pressure chamber 3 in communication with the atmospheric compartment 4. The apparatus 5 comprises a hollow outer rotary shaft 6 rotatably disposed within a tubular casing, an earth conveying screw blade 7 attached to the outer periphery of the shaft 6, an inner rotary shaft 8 rotatably supported by the outer shaft 6 and having a projection extending outward from the shaft 6 into the pressure chamber 3, and an earth kneading screw blade 9 attached to the projection of the shaft 8. The outer shaft 6 is supported at one end by the tubular casing, while the inner shaft 8 has its forward end supported at the center of rotation of the cutter head 2, whereby the screw conveyor 6, 7, 8 and 9 is retained in a specified position. Indicated at 10 is a conveyor by which the earth discharged from the apparatus 5 is transported to a suitable location.

As already described, the earth removing apparatus 5 of the above construction is limited in the freedom of design and mechanically involves objections since the screw conveyor 6, 7, 8 and 9 must be arranged horizontally with its forward end supported at the center of rotation of the cutter head 2 which is rotatingly driven completely independently of the conveyor. Further when the shield main body 1 has a small diameter, there arises a need to incline the apparatus 5 to increase the distance between the bottom of the apparatus 5 and the bottom of the shield main body 1 at the location where one end of the conveyor 10 is positioned. This entails the problem that the cutter head 2 must also be inclined so as to be perpendicular to the screw conveyor 6, 7, 8 and 9.

An embodiment of the invention will be described below which has been accomplished to overcome the above problems.

Figure 2:
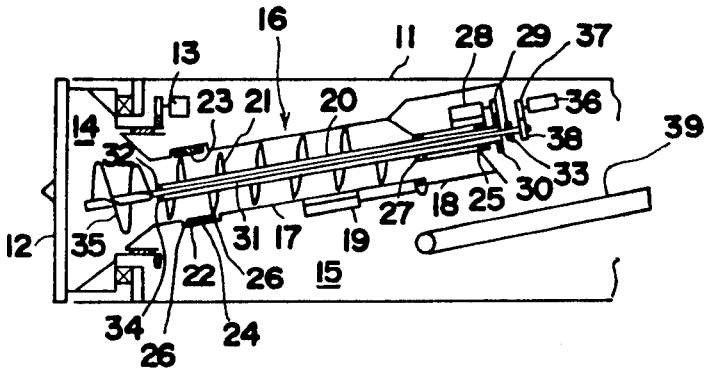
FIG. 2 is a view in longitudinal section showing a shield tunneling machine equipped with an earth removing apparatus of the invention.
Figure 3:
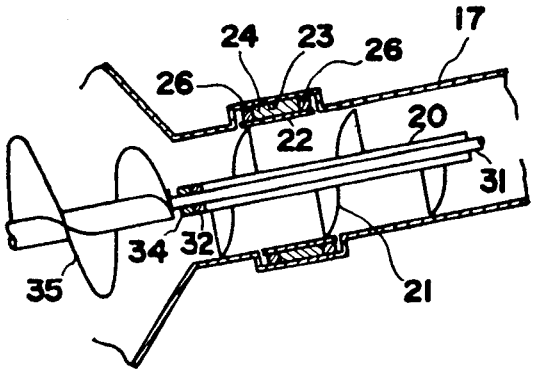
FIG. 3 is a fragmentary enlarged view in section of FIG. 2.

With reference to FIGS. 2 and 3, a shield main body 11 having a contour in conformity with the shape of the tunnel to be excavated is rotatably provided at its one end (front end) with a cutter head 12 which is rotatable by a drive unit 13. A pressure chamber 14 is formed immediately behind the cutter head 12, and an atmospheric compartment 15 is provided in the rear of the chamber 14. The arrangement described above is similar to the corresponding one shown in FIG. 1, but an earth removing apparatus 16 is in an inclined position.

The apparatus 16 includes a tubular casing 17 which is fixedly supported by the shield main body 11 and which has an earth inlet formed at one end (front end) and communicating with the pressure chamber 14 and an earth outlet formed at the other end (rear end) and closable with a door 18. The door 18 is movable by a cylinder unit 19. A hollow outer rotary shaft 20 is rotatably disposed within the casing 17 and provided with an earth conveying helical screw blade 21 on its outer periphery. The rotary shaft 20 has a front end portion supported by an annular member 22 attached to the outer periphery of the screw blade 21, on a bearing 24 which is provided in an annular recess 23 formed in the casing 17. The shaft 20 has a rear end portion supported by a bearing 25 on the casing 17. The bearings 24, 25 are sealed off by seals 26, 27. The rotary shaft 20 is rotatingly driven with the screw blade 21 by a drive unit 28 provided at the rear end of the casing, through gears 29 and 30. An inner rotary shaft 31 rotatably extends through the outer shaft 20 and has a front end projecting beyond the front end of the outer shaft 20 into the pressure chamber 14. The inner shaft 31 is supported by a bearing 32 on the front end of the outer shaft 20 and by a bearing 33 on the rear end of the casing 17. The bearing 32 is sealed off by a seal 34. An earth kneading screw blade 35 is attached to the projection of the inner shaft 31 and is rotatingly driven with the shaft 31 by a drive unit 36 through gears 37 and 38.

Figure 4:
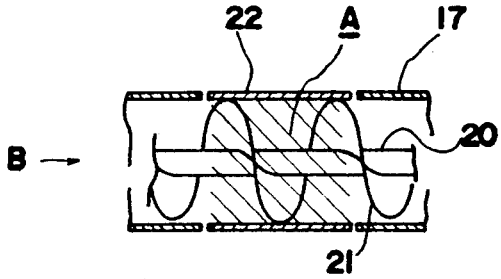
FIG. 4 is a diagram illustrating the relation between the axial length of an annular member and the pitch of a screw blade.

It is desirable that the axial length of the annular member 22 be smaller than the pitch of the earth conveying screw blade 21 for the following reason. The annular member 22 is fixed to the screw blade 21 and therefore is not movable relative to the blade 21, and the conveying channel section A surrounded by the annular member 22 and shown in FIG. 4 has no conveying ability in itself. Accordingly the portion of earth entering this section A is passively carried forward by being pushed out by another portion of earth forwarded from a lower section. However, if the axial length of the annular member 22 is larger than the pitch of the screw blade 21, the blade 21 extends a full turn in the section A, such that the section A appears fully closed by the blade 21 when seen in the direction B shown in FIG. 4. This seriously impedes the forward movement of earth from the section A, with the possible result that the conveyor becomes unable to transport the earth due to the stagnation of earth in the section A.

The shield tunneling machine of the foregoing construction operates in the following manner. First, the cutter head 12 driven by the drive unit 13 excavates the ground in front thereof. The excavated earth enters the pressure chamber 14 through slits formed in the cutter head 12. The earth is efficiently kneaded by the screw blade 35 with slime which is injected into the pressure chamber 14 by unillustrated suitable means, filling up the pressure chamber 14 to build up the internal pressure and effectively prevent collapse of the ground in the front. The fluidized earth is thereafter transported through the casing 17 by the conveying screw blade 21. During the transport, the annular member 22 fitting in the annular recess 23 of the casing without projecting into the conveying channel will not interfere with the conveying operation. Further because the axial length of the annular member 22 is smaller than the pitch of the conveying screw blade 21, the transport of the earth will not be hindered in any way. The earth is eventually discharged from the outlet and carried away by a conveyor 39.

Figure 5:
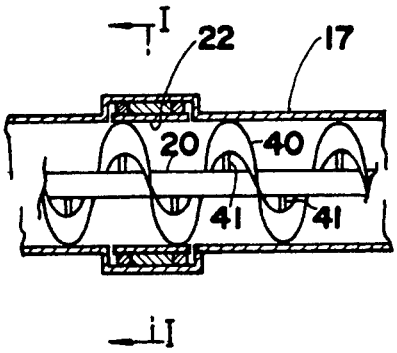
FIG. 5 is a view in longitudinal section showing a modified mode of attaching a screw blade to a shaft.
Figure 6:
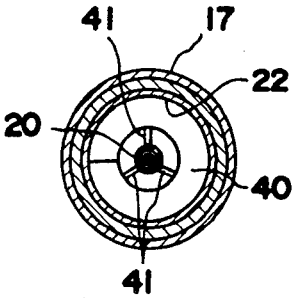
FIG. 6 is a view in section taken along the line I—I in FIG. 5.

Although the screw blade 21 is attached directly to the outer rotary shaft 20 in the foregoing embodiment, a helical screw blade 40 may be attached indirectly to the rotary shaft 20 by spokes 41 as shown in FIGS. 5 and 6.

Figure 7:
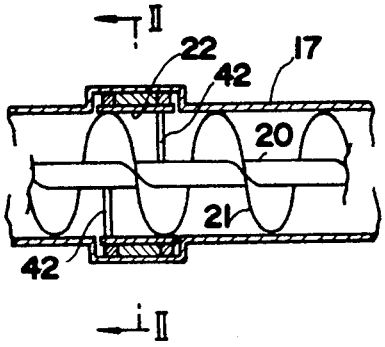
FIG. 7 is a view in longitudinal section showing a modified mode of attaching the annular member to the shaft.
Figure 8:
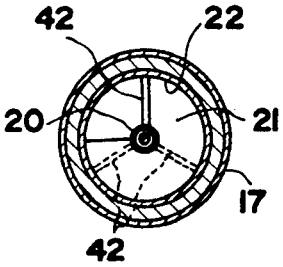
FIG. 8 is a view in section taken along the line II—II in FIG. 7.

Further the annular member 22 may be fixed to the outer rotary shaft 20 by spokes 42 as seen in FIGS. 7 and 8.

The casing 17 can of course be arranged in a horizontal or inclined position.

What is claimed is:

1. An earth removing apparatus for a shield tunneling machine comprising a tubular casing having an excavated earth inlet at one end thereof and a closable outlet for excavated earth at the other end; a hollow outer rotary shaft rotatably disposed within the casing and provided with earth conveying blade means on its outer periphery, the rotary shaft being rotatably supported on the casing by an annular member provided around the blade means and rotatably received through a bearing in an annular recess formed in the casing adjacent said one end thereof; and an inner rotary shaft rotatably extending through one end of the outer rotary shaft and having a projection extending through one end of the outer rotary shaft and through the earth inlet of the casing, the shaft projection being provided with earth kneading blade means.

2. An earth removing apparatus as defined in claim 1 wherein the earth conveying blade means comprises a screw blade, and the annular member is attached directly to the outer peripheral edge of the screw blade.

3. An earth removing apparatus as defined in claim 2 wherein the annular member has an axial length smaller than the pitch of the screw blade.

4. An earth removing apparatus as defined in claim 2 wherein the screw blade is attached directly to the outer rotary shaft.

5. An earth removing apparatus as defined in claim 2 wherein the screw blade is attached to the outer rotary shaft by spokes.

6. An earth removing apparatus as defined in claim 1 wherein the annular member is attached to the outer rotary shaft by spokes.

7. An earth removing apparatus as defined in claim 1 wherein the earth kneading blade means comprises a screw blade.

8. A shield tunneling machine comprising a hollow main body; a cutter head rotatably disposed at one end of the main body; a pressure chamber formed within the main body immediately behind the cutter head; an atmospheric pressure compartment formed within the main body in the rear of the pressure chamber; and an earth removing apparatus provided within the main body and holding the pressure chamber in communication with the atmospheric pressure compartment; the earth removing apparatus comprising a tubular casing having an excavated earth inlet opening to the pressure chamber and a closable excavated earth outlet communicating with the atmospheric pressure compartment; a hollow outer rotary shaft rotatably disposed within the casing and provided with earth conveying blade means on its outer periphery, the rotary shaft being rotatably supported on the casing by an annular member provided around the blade means and rotatably received through a bearing in an annular recess formed in the casing adjacent the earth inlet thereof; and an inner rotary shaft rotatably extending through the outer rotary shaft and having a projection extending through one end of the outer rotary shaft into the pressure chamber, the shaft projection being provided with earth kneading blade means.

* * * * *